US007037182B2

(12) United States Patent
Montresor

(10) Patent No.: US 7,037,182 B2
(45) Date of Patent: May 2, 2006

(54) TEMPLATE DEVICE FOR THE CONTROL OF THE MOVEMENTS OF DIAMOND MILLING CUTTERS OR THE LIKE, TO BE MOUNTED ON MARBLE OR STONE SLAB BORDER POLISHING MACHINES

(76) Inventor: Nicola Montresor, Via Ugo Foscolo, 10/A Sommacompagna (Verona) (IT)

( * ) Notice: Subject to any disclaimer, the term of this patent is extended or adjusted under 35 U.S.C. 154(b) by 0 days.

(21) Appl. No.: 10/949,496

(22) Filed: Sep. 24, 2004

(65) Prior Publication Data

US 2005/0074306 A1 Apr. 7, 2005

(30) Foreign Application Priority Data

Oct. 1, 2003 (IT) ..... VR20030049 U

(51) Int. Cl.
*B24B 9/06* (2006.01)

(52) U.S. Cl. ..... 451/281

(58) Field of Classification Search ..... 451/281, 451/451, 282; 409/179
See application file for complete search history.

(56) References Cited

U.S. PATENT DOCUMENTS 3,811,230 A * 5/1974 Beck ..... 451/281
4,459,780 A * 7/1984 Imahashi ..... 451/239
5,127,195 A 7/1992 Heesemann
5,183,373 A * 2/1993 Floyd, Jr. ..... 409/179
5,492,037 A * 2/1996 Graham ..... 26/83
5,575,656 A * 11/1996 Hajjar ..... 433/219
6,196,902 B1 * 3/2001 Gazca-Ortiz et al. ..... 451/242

FOREIGN PATENT DOCUMENTS

| | | |
|---|---|---|
| DE | 102 02 347 | 7/2003 |
| EP | 0 196 941 | 10/1986 |
| JP | 08 001490 | 1/1996 |

* cited by examiner

*Primary Examiner*—Jacob K. Ackun, Jr.
(74) *Attorney, Agent, or Firm*—Notaro & Michalos, PC

(57) ABSTRACT

The template device according to the present invention permits to determine the procedure for an angular displacement of the diamond milling cutter heads in respect to the size of the slab to be worked, and precisely the slab thickness, in order to obtain the same profile of the template. The lower part of the template (1) is orthogonal to the direction of feed of the slab (4) and forms a base (5) which is provided with coupling means which permit the coupling with the supporting frame (6) of the slab border polishing machine in the feed sector of the slab itself. The said coupling means which permit the coupling with the supporting frame or bracket (6) may be screws or other similar coupling means. The said template (1) cooperates with contact elements such as a sliding block (7) or the like which are arranged on the delivery side of the shaft of a spindle (8) which is equipped with a diamond milling cutter (9).

7 Claims, 3 Drawing Sheets

TEMPLATE DEVICE FOR THE CONTROL OF THE MOVEMENTS OF DIAMOND MILLING CUTTERS OR THE LIKE, TO BE MOUNTED ON MARBLE OR STONE SLAB BORDER POLISHING MACHINES

FIELD AND BACKGROUND OF THE INVENTION

The present invention refers to a template device for the control of the movements of diamond milling cutters or the like, to be mounted on stone or marble slab border polishing machines.

As is known, different operative machines are utilized in the area of the working of stone or marble materials. These machines include the ones that form and polish the borders of slabs made of granite, marble, stone and glazed materials.

The so-called slab border polishing machines permit polishing the slab borders, for instance, when it is necessary to produce kitchen planes and shelves or surfaces provided with a toroidal border. The machine is therefore equipped with components that permit the raw slab to be subjected to the roughing and polishing operations so as to obtain a perfectly polished slab border.

The conventional slab border polishing machines are provided with a horizontal supporting plane provided with a conveyor belt. The marble or stone slab to be worked is placed on the conveyor belt so that the slab advances progressively.

In the proximity of the rear of the machine and more precisely, beyond the conveyor belt, there is a working unit provided with working and polishing tools. As the slab advances linearly at a constant speed, the tools work and polish the slab.

The working and polishing tools include a series of heads. Each head is provided with a grinder. The heads are arranged side by side and in parallel succession on supports that permit the heads to be displaced angularly with respect to the working center of the slab border. Some of the heads and, in particular, the ones located upstream with respect to the direction of feed of the slab to be worked, are employed to form the slab border, for instance when it is necessary to obtain toroidal profiles.

In such cases, first the slab is beveled and then, the slab is placed on the conveyor belt to be subjected rounding off through the diamond milling cutters or grinders. As the slab advances, it is polished through further grinders for a perfect finishing.

In some cases, the diamond milling grinders are shaped grinders provided with a fixed shaft, which necessitates expensive, milling cutters of different dimensions. In addition, these milling cutters deform easily and damage rapidly.

In other known solutions, the cutter spindle is mounted on arcuate guides or connecting rod devices and/or four-bar linkages. In these cases, there is the problem that the constructive structure is complex and the wear and tear is high because the kinematic gears must be able to draw the head movement according to concentric shapes to the profile to be created.

The known type of actuation of the diamond grinders in the slab border polishing machines was very complex and expensive and involved many difficulties regarding the construction and operation of the machine. The costs of such machines and the costs of their operation were too high.

SUMMARY OF THE INVENTION

The aim of the present invention is to remove the above inconveniences through the utilization of a template or "copy" device which controls the work of the tool independently from the trajectory drawn by the mechanism which moves the spindle.

In particular, the template device according to the present invention permits determination of the procedure for an angular displacement of the diamond milling cutter heads with respect to the size of the slab to be worked, and precisely the slab thickness, in order to obtain the same profile of the template.

The present template device is applied to the border of the slab to be worked and cooperates with a tracer point unit or sliding block which is integral with the delivery side of the grinder or cutter.

The present device is used to obtain the necessary working precision in the slab border rough machining and polishing phases. Further, the present device allows interchanging the shapes of the template on the base of the different dimensions and shapes of the piece to be treated. In addition, the movements of the working heads are simplified and the wear and tear of the kinematic gears is reduced. In addition, the present device permits obtaining products with precise shapes also when the kinematic gears of the spindle mechanism are not perfectly engaged.

The template device according to the present invention is practical and economically favorable because it is carried out at very low costs, including the costs of upkeep and operation.

In addition, the template device according to the present invention can be carried out with profiles of different shapes and, above all, of different dimensions so that the grinders can shape slabs of any thickness through a simple change and/or adjustment of the template or tool.

All the above indicated aims and advantages are reached according to the present invention through a template device for the control of the movements of diamond milling cutters or the like, which template device is mounted on a stone or marble slab border polishing machine; the main feature of this template device is that it is formed by an essentially circle arc-shaped piece although this piece may be other shapes; the arc-shaped piece is referred to as a templating arc and is orthogonal to the direction of feed of the slab; the lower part of the template forms a base which is provided with coupling and adjusting means for the coupling and adjusting with the supporting frame of the slab border polishing machine in the feed sector of the slab in order to internally include the toroidal border of the slab; and that the said template cooperates with contact elements such as a sliding block or rolls, or the like, which are arranged on the delivery side of the shaft of a spindle which is equipped with a diamond milling cutter.

The spindle may effect angular displacements controlled by the sliding block which remains tangent to the template, and the tool always remains in the correct position to create or shape the border of the slab.

The tool is maintained in its thrust condition by the tool rotation shaft which acts against pneumatic and/or hydraulic means.

Further features and advantages of the present invention will be better understood from the following specification that is provided as a non-exclusive example accompanied by drawings.

DESCRIPTION OF THE PREFERRED EMBODIMENTS

Figure 1:
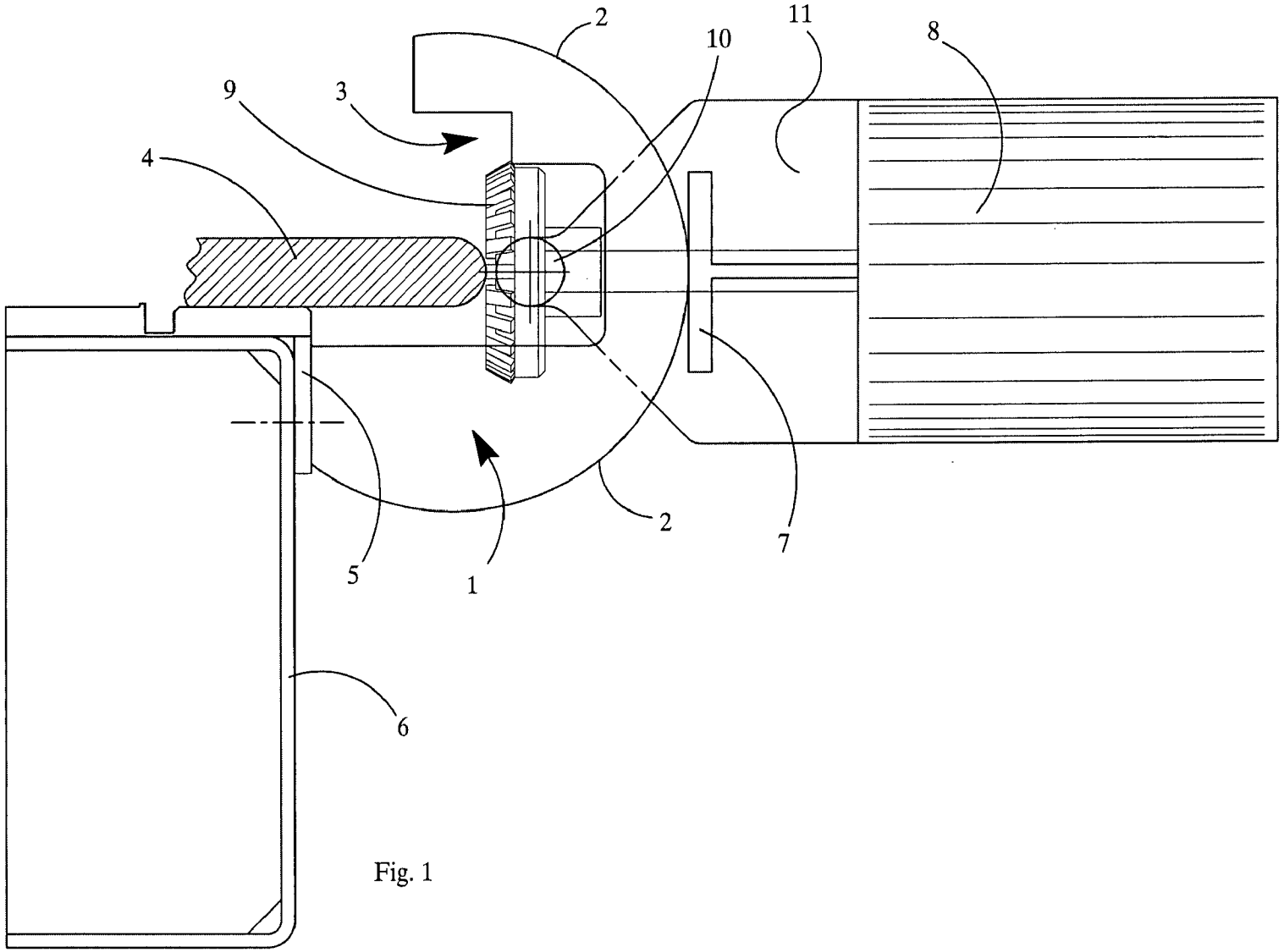
FIG. 1 is a lateral schematic view of the template according to the present invention in which the template is arranged on the edge of the frame of the conveyor belt that conveys the slab and acts against antagonistic means of the diamond milling head.
Figure 3:
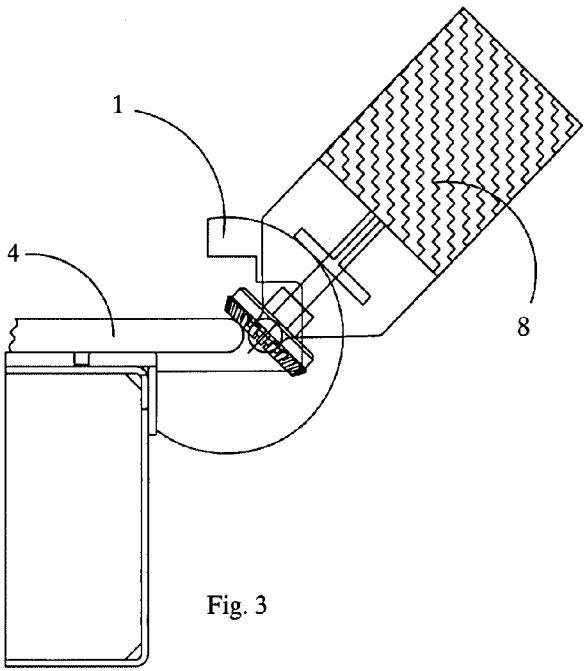
FIG. 3 is a schematic view showing a second type of movement effected by the diamond milling cutter head with respect to the templating arc of the template.
Figure 2:
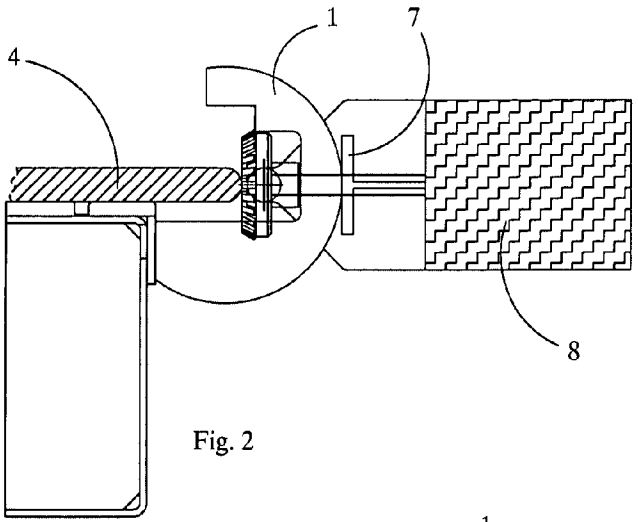
FIG. 2 is a schematic view showing a first type of movement effected by the diamond milling cutter head with respect to the templating arc of the template.
Figure 4:
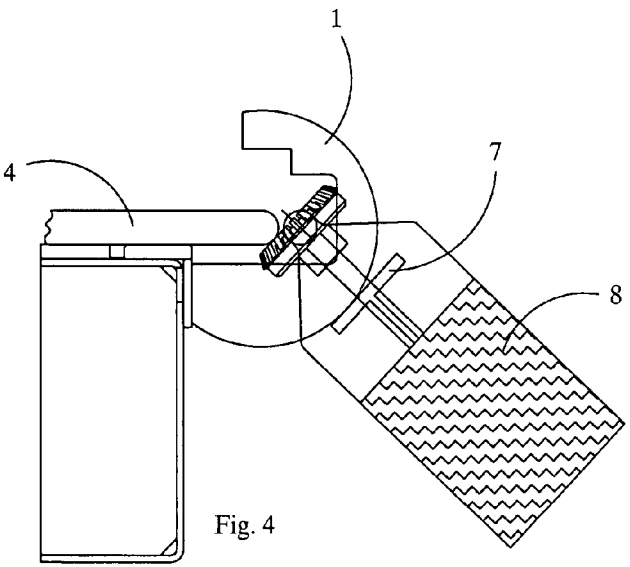
FIG. 4 is a schematic view showing a third type of movement effected by the diamond milling cutter head with respect to the templating arc of the template.

With reference to the accompanying drawings, and in particular FIG. 1, reference number 1 denotes a template according to the present invention. The template 1 has an essentially planar arc shape or other shape that corresponds to the profiles to be obtained. The template 1 includes a templating arc 2 in its external portion and a recess 3 in its internal portion. A slab 4 includes a slab border to be worked. The slab border is inserted in the recess 3.

The lower part of the template 1 is orthogonal to the direction of feed of the slab 4 and forms a base or bracket 5 which is provided with coupling means which permit coupling with the supporting frame 6 of the slab border polishing machine in the feed area of the slab itself. The coupling means of the bracket 5 may be screws or other similar coupling means. The template 1 cooperates with contact elements, such as a sliding block 7 or the like, which are arranged on the delivery side of the shaft of a spindle 8 which is equipped with a diamond milling cutter 9.

The sliding block 7 forms an adjusting bracket. When the sliding block or adjusting bracket touches the template 1, it permits the milling cutter 9 to touch the slab border. This is due to the fact that the spindle 8 is placed through a supporting plate 11 on a fulcrum 10. In addition, the spindle shaft slides axially and remains in a pushing condition towards the border of the slab 4 through a pneumatic system which maintains the milling cutter 9 in contact with of the border of the slab in order to obtain the desired profile.

In addition, the delivery side of the diamond milling cutter 9 is constrained to the adjusting bracket 7 and as a consequence, when the spindle rotates, the milling cutter 9 follows the profile of the shaping arc in order to obtain the shape on the piece to be worked.

The radius of the template 1, namely the distance between the center and border of the templating or shaping arc, is calculated exactly in proportion to the slab thickness, Consequently, when there is a change in the thickness, for instance in case it is necessary to work slabs of different dimensions, it is possible to replace the template with other suitable templates. Otherwise it is possible to adjust the position of the template as well as the position of the milling cutter with respect to the sliding block 7. In this regard, it is to be noted that the sliding block is arranged at a predetermined distance from the working surface of the milling cutter 9, namely at a distance reflected by the shape of the template 1.

For the working of the border of the slab 4 it is sufficient to apply a template 1 to the machine, which template must correspond to the slab to be worked. Then, the work cycle is started. As the slab is fed on the conveyor belt, the diamond milling group swing angularly with respect to the fulcrum 10 through motorized displacement means.

The adjusting bracket 7 or tracer point remains constantly in contact with the templating arc 2 of the template and the milling cutter 9 remains constantly in the desired position so that it is possible to obtain the wished slab profile.

Figure 5:
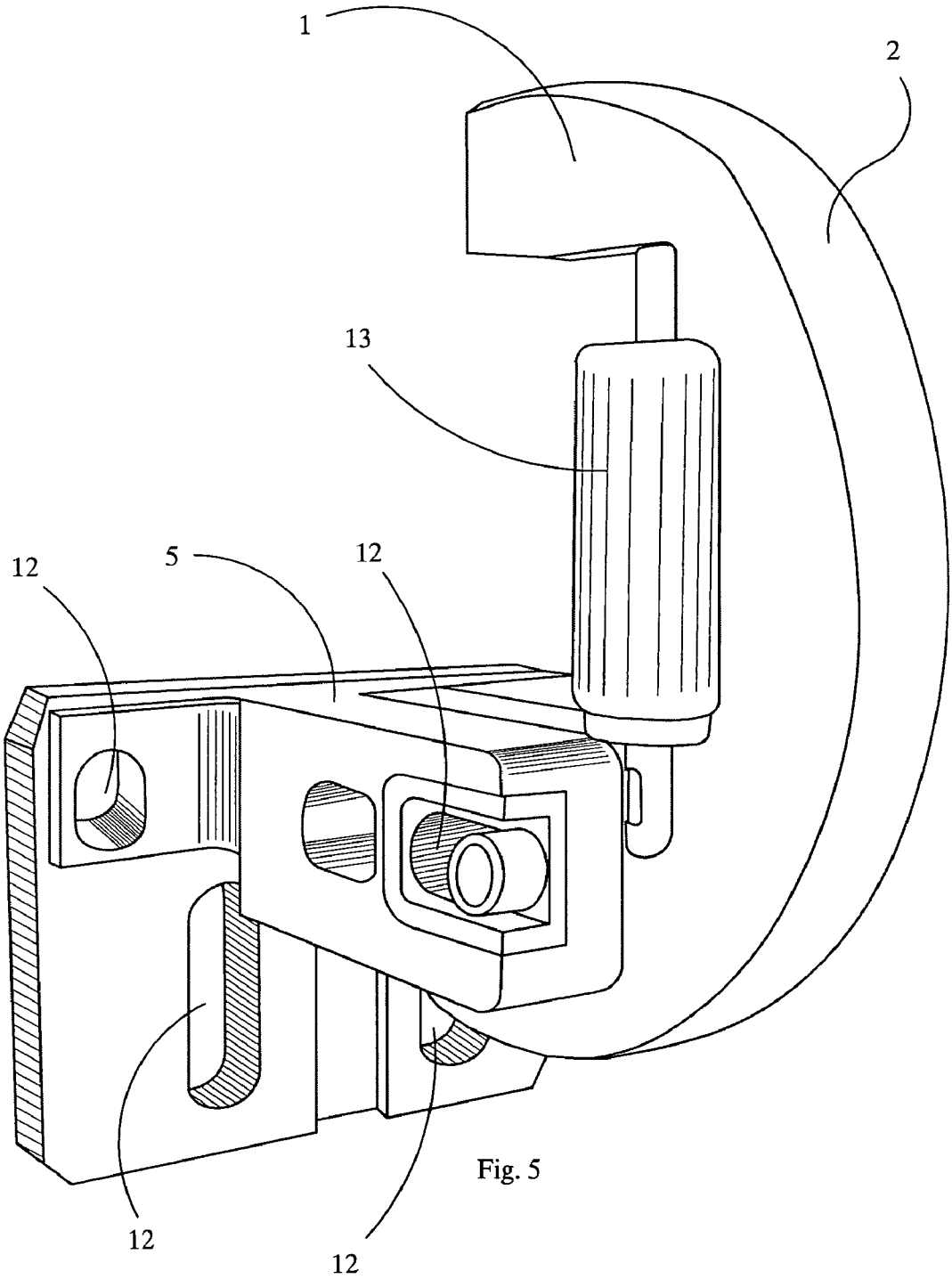
FIG. 5 is a schematic perspective view of the template mounted on an adjustable bracket.

As represented in FIG. 5, the template may be carried out with a supporting bracket 5 which is carried out as a separate piece and is provided with adjusting means such as slots 12. On the one hand, the slots 12 permit the template body to be fixed and on the other hand, the slots 12 permit the bracket to be fixed to the machine with fixing and adjusting means in which screws are utilized. In this way, it is possible to horizontally and vertically adjust the template on its support 5 so that different workings are made on the slab.

FIG. 5 also shows a roll 13 which makes the sliding of the slab easier when the slab is fed on the conveyor belt.

Advantageously, it is provided that only a template may interlock more diamond heads, each of them being provided with a tracer point or sliding block 7. In this case, the border of the templating arc must be carried out with a higher thickness in order to receive pairs of independent sliding blocks.

A further advantage is that by utilizing the described system, when the movement of the spindle has mechanical plays that are not relevant, the arcuated pattern created by the tool is always precise for the employment of the template 1. The template determines the depth of the profile cutting constantly and without errors.

In addition, it is to be noted that the wear and tear of the milling cutter is reduced by adjusting the distance of the milling cutter from the sliding block 7.

As can be seen, the described template device provides the necessary work precision in the slab border rough machining and polishing phases. In addition, the movements of the working heads are simplified and the wear and tear of the kinematic gears is reduced. Further, the present device provides products with precise shapes, even when the kinematic gears of the spindle mechanism are not engaged perfectly. In other words, the described template controls the work of the tool regardless of the trajectory of the mechanism that moves the spindle.

A technician of the field in question may also provide changes and modifications to the described template for the control of the diamond milling cutters and obtain solutions that are to be considered as included in the scope of protection of the invention as further defined in its unique features in the following claims.

The invention claimed is:

1. Template device (1) for control of movements of diamond milling cutters, which template device is mounted on a stone or marble slab border polishing machine, characterized in that the template device is formed by an arc-shaped piece, the arc-shaped piece being arranged orthogonally to a direction of feed of a slab; a lower part of the template device forming a base provided with coupling and adjusting means for permitting coupling and adjusting with a supporting frame (6) of the slab border polishing machine in a feed area of the slab in order to internally include the border of the slab; and that said template device cooperates with contact elements arranged on a delivery side of a shaft of a spindle (8) which is equipped with a diamond milling cutter (9).

2. Template device, as claimed in claim 1, characterized in that:

the contact elements are a sliding block (7) and the said spindle (8) affects angular displacements controlled by the sliding block (7) which remains tangent to the said template (1) and a tool (9) always remains in a correct position to create or shape the border of the slab (4); and the tool (9) is maintained in its thrust condition by a tool rotation shaft which acts against pneumatic and/or hydraulic means.

3. Template device, as claimed in claim 1, characterized in that the lower part of the template device (1) is orthogonal to the direction of feed of the slab (4) and forms a base or bracket (5) which is provided with coupling means for coupling with the supporting frame (6) of the slab border polishing machine in the feed area of the slab itself.

4. Template device, as claimed in claim 1, characterized in that a supporting bracket (5) is carried out as a separate piece and is provided with slots (12); the slots (12) permitting the template body to be fixed and the bracket to be fixed to the machine with fixing and adjusting means in which screws are utilized.

5. Template device, as claimed in claim 1, characterized in that a roll (13) makes sliding of the slab easier during slab feeding on a conveyor belt.

6. Template device, as claimed in claim 1, wherein the template device is not fixed to slabs being fed to template device.

7. Template device according to claim 2, wherein the template device (1) is in contact with the tool (9).

* * * * *